US010150587B2

(12) United States Patent
Berling et al.

(10) Patent No.: US 10,150,587 B2
(45) Date of Patent: Dec. 11, 2018

(54) HINGE ASSEMBLY AND CONTAINER WITH SUCH A HINGE ASSEMBLY

(71) Applicant: SCHOELLER ALLIBERT GMBH, Schwerin (DE)

(72) Inventors: Michael Berling, Schwerin (DE); Steve Loftus, Schwerin (DE)

(73) Assignee: SCHOELLER ALLIBERT GMBH, Schwerin (DE)

( * ) Notice: Subject to any disclaimer, the term of this patent is extended or adjusted under 35 U.S.C. 154(b) by 0 days.

(21) Appl. No.: 15/659,301

(22) Filed: Jul. 25, 2017

(65) Prior Publication Data

US 2018/0029748 A1 Feb. 1, 2018

(30) Foreign Application Priority Data

Jul. 29, 2016 (DE) ..... 10 2016 114 065

(51) Int. Cl.
*E05D 7/10* (2006.01)
*B65D 6/18* (2006.01)
(Continued)

(52) U.S. Cl.
CPC ..... *B65D 11/184* (2013.01); *B65D 11/1833* (2013.01); *B65D 11/20* (2013.01);
(Continued)

(58) Field of Classification Search
CPC ... B65D 11/18; B65D 11/184; B65D 11/1806; B65D 11/20; B65D 11/1873;
(Continued)

(56) References Cited

U.S. PATENT DOCUMENTS 3,941,271 A * 3/1976 Zarges ..... B65D 7/26 217/13
4,163,495 A * 8/1979 Drader ..... B65D 11/1833 206/506
(Continued)

FOREIGN PATENT DOCUMENTS

CN 104944012 A 9/2015
DE 21 45 550 3/1973
(Continued)

OTHER PUBLICATIONS

German Search Report for DE 10 2016 114 065.1 dated Nov. 28, 2016, with translation.
(Continued)

*Primary Examiner* — Chuck Y Mah
(74) *Attorney, Agent, or Firm* — RatnerPrestia

(57) ABSTRACT

A hinge assembly is disclosed between two walls sections of a container which are pivotable relative to one another, with a hinge pin provided at a first wall section and a hinge pin attachment provided at a second wall section, the hinge pin fitting positively in the hinge pin attachment and being rotationally and translationally movable in such a way as to allow a parallel shift of the rotational axis of the hinge pin. A pair of guide contours are provided on the wall sections, in contact with one another and formed separately from the hinge pin and hinge pin attachment to define a simultaneous rotational and translational movement of the hinge pin in the hinge pin attachment.

14 Claims, 6 Drawing Sheets

(51) Int. Cl.
*B65D 6/00* (2006.01)
*B65D 19/18* (2006.01)

(52) U.S. Cl.
CPC ..... *B65D 19/18* (2013.01); *B65D 2251/1008* (2013.01); *B65D 2251/1016* (2013.01); *B65D 2519/009* (2013.01); *B65D 2519/00034* (2013.01); *B65D 2519/00069* (2013.01); *B65D 2519/00174* (2013.01); *B65D 2519/00208* (2013.01); *B65D 2519/00333* (2013.01); *B65D 2519/00497* (2013.01); *B65D 2519/00611* (2013.01); *B65D 2519/00651* (2013.01); *B65D 2519/00711* (2013.01); *B65D 2519/00975* (2013.01)

(58) Field of Classification Search
CPC .... B65D 2251/1008; B65D 2251/1016; B65D 11/1833; B65D 2519/00587; B65D 2519/00599; B65D 2519/009; Y10T 16/5361; Y10T 16/53613; Y10T 16/5362; Y10T 16/544; Y10T 16/545; E05D 1/04; E05D 1/06
See application file for complete search history.

(56) References Cited

U.S. PATENT DOCUMENTS

| | | | | | |
|---|---|---|---|---|---|
| 5,070,577 | A * | 12/1991 | Bonneville | B65D 11/1833 | 16/260 |
| 5,812,285 | A * | 9/1998 | Lin | G03B 27/6228 | 355/25 |
| 5,815,886 | A * | 10/1998 | Nishio | E05D 11/0027 | 16/360 |
| 5,979,016 | A * | 11/1999 | Fan | E05D 7/1077 | 16/266 |
| 6,293,417 | B1 * | 9/2001 | Varfeldt | B65D 11/1833 | 220/6 |
| 6,351,373 | B1 * | 2/2002 | Le | H01R 13/629 | 16/325 |
| 6,918,508 | B2 * | 7/2005 | Hwang | B65D 21/022 | 16/266 |
| 6,972,878 | B2 * | 12/2005 | Shyu | H04N 1/00519 | 16/239 |
| 7,104,414 | B2 | 9/2006 | Apps et al. | | |
| 8,381,929 | B2 | 2/2013 | Kellerer et al. | | |
| 8,627,973 | B2 | 1/2014 | Dekkers | | |
| 8,727,158 | B2 * | 5/2014 | Nolan | B65D 19/18 | 220/6 |
| 8,727,165 | B2 * | 5/2014 | Nolan | B65D 11/18 | 16/246 |
| 8,915,397 | B2 * | 12/2014 | Petersen | B65D 11/20 | 220/4.28 |
| 2011/0272400 | A1 | 11/2011 | Huizingh | | |

FOREIGN PATENT DOCUMENTS

| | | |
|---|---|---|
| DE | 2352533 | 4/1975 |
| DE | 601 05 371 | 9/2005 |
| EP | 1840038 A1 | 10/2007 |
| EP | 2 389 321 | 11/2011 |
| EP | 2 563 678 | 3/2013 |
| JP | 2006089067 A | 4/2006 |

OTHER PUBLICATIONS

Extended European Search Report for European Application No. 17183363.5, dated Dec. 19, 2017, including English language translation, 13 pages.

* cited by examiner

HINGE ASSEMBLY AND CONTAINER WITH SUCH A HINGE ASSEMBLY

CROSS REFERENCE TO RELATED APPLICATIONS

This application claims priority to German application DE 10 2016 114 065.1 filed Jul. 29, 2016, the contents of such application being incorporated by reference herein.

FIELD OF THE INVENTION

The present invention refers to a hinge assembly between two wall sections of a container which are pivotable relative to one another according to the independent claim and a container with such a hinge assembly according the dependent claims.

BACKGROUND OF THE INVENTION

Various containers are known from the state of the art with folding side walls, whereby the side walls can be moved into a vertical or upright position for the purpose of transporting or storing goods and can be folded inwards or outwards when the container is to be transported or stored in an empty state in order to save space. Such folding containers also include so-called Intermediate Bulk Containers (IBC), which are generally designed for the transport or storage of liquid or granulated materials and which are designed to hold larger volumes. In view of this, such containers are subject to rigorous demands in terms of strength.

In order to enable maximum force transmission, the contact area of an upright side wall on a lower side wall section or base should be as wide as possible. In order to enable the side walls to pivot, a hinge pin is usually configured at the bottom edge of the foldable side wall which is rotatably mounted in a corresponding hinge pin attachment of the side wall or base section. In order to enable the side wall to fold inwards or outwards, the inner or outer edge of the lower side wall section generally comprises a radius so that the upper side wall can perform the pivoting movement. However, such a radius reduces the width of the contact area in the upright state of the side wall, thereby causing a weakening of the container's strength.

DESCRIPTION OF THE RELATED ART

In addition to fixed hinge axes, hinge axes are also known, for example from EP 2 563 678 A1 and EP 2 389 321 A1, in which the hinge pins have a degree of vertical translational freedom so as to not to have to adhere to any particular order of folding in the case of side walls that fold on top of one another, and so that, when folded on top of each other, the side walls can lay flat on top of each other due to the non-fixed hinge axis. The disadvantage of such a vertically movable hinge joint, however, is that in their upright state, the side walls are not directly connected to the base but only held in place via the neighboring side walls. In view of the strength requirements, this is in need of improvement. Another disadvantage of a freely movable hinge axis lies in the fact that in the case of several hinge attachments, the (height) position of the hinge pin can vary, so the hinge parts which can pivot relative to one another can easily become jammed or break. Documents DE 235 25 33 A1, DE 21 45 550 C3, U.S. Pat. No. 8,627,973 B2 and U.S. Pat. No. 4,163,495 A present further examples of containers with lids or walls which are hinged by means of translationally movable hinge axes.

SUMMARY OF THE INVENTION

In view of this, an object of the following invention is to provide a container with foldable side walls or side wall sections which exhibits improved force transmission of the side walls and greater overall strength of the container. In particular, the object is to provide a corresponding hinge assembly between two side wall sections which are pivotable or foldable relative to each other.

This object is achieved in terms of the hinge assembly by the features of the independent claim and in terms of the container by the features of a dependent claim. Advantageous embodiments are the subject of dependent claims.

A hinge assembly according to aspects of the invention between two wall sections of a container which can be pivoted relative to one another, such as between a side wall and a base section or between two side wall sections, comprises a hinge pin provided at a first wall section and a hinge pin attachment provided at a second wall section. The hinge pin fits positively in the hinge pin attachment, i.e. the hinge pin and the hinge pin attachment do not become separated in the course of normal use and can at most be separated for repair or replacement purposes. Furthermore, the hinge pin is rotatably mounted in the hinge pin attachment and also translationally mounted in such a way as to allow a parallel shift of the rotational axis of the hinge pin. According to aspects of the invention, a pair of guide contours is provided which remain in contact with each other or slide against one another during the pivoting or folding movement of the wall sections and are configured separately from the hinge pin and the hinge pin attachment. In particular, "separately" from the hinge pin and the hinge pin attachment means "separately" in the longitudinal direction and extension direction, respectively, of the wall sections. In particular, the pair of guide contours is provided in such a way that an imaginary line between the pair of guide contours and the hinge pin/the hinge pin attachment is substantially parallel to the longitudinal direction and extension direction, respectively, of the wall sections. The rotational and translational movement of the hinge pin in the hinge pin attachment is defined by this pair of guide contours. Furthermore, the guide contour according to aspects of the invention is configured in such a way that when the wall sections are pivoted from the open to the closed position, a rotational axis defined by the hinge pin initially moves away from a starting position and then moves back into it. In this way, the two end positions of the hinge assembly according to aspects of the invention, i.e. in the open state and in the closed state, correspond to the end positions provided by a hinge with a fixed rotational axis. In view of this, the hinge according to aspects of the invention does not have any effect on the other dimensions of the container, so existing container concepts can be fitted with a hinge assembly according to aspects of the invention without major adaptations.

The advantage of the hinge assembly according to aspects of the invention lies especially in the fact that the interplay between the hinge pin and hinge pin attachment essentially allows a (simultaneous) rotational and translational movement, while on the other hand the pair of guide contours defines or specifies the (simultaneous) rotational and translational movement of the hinge pin in the hinge pin attachment during the pivoting movement. This prevents the hinge pin and hinge pin attachment from becoming entangled or jammed and means that folding and unfolding of the side wall can be carried out in a straightforward manner by the user without having to pay particular attention, since the guide contour defines the movement curve. Due to the degree of translational freedom of the hinge pin or hinge axis, it is possible to dispense with a bevelling or rounding of wall section edges while still enabling both a flat standing position of the side wall in the upright state and also a pivoting movement per se. In this way, the contact surface is increased as compared to solutions with fixed hinge axes, thereby improving the container's strength and force transmission.

According to one aspect of the invention, the wall sections can be moved from an open/unfolded to a closed/folded position and vice versa. This enables space-saving storage. The first wall section can be a side wall or a first side wall section of a container. The second wall section can be a raised, essentially vertically extending edge section of a base or a second side wall section articulately jointed with the first side wall section. In the open position, the first wall section and the second wall section are aligned with each other, and the opposite front edges of the wall sections lie flat against each other. In the closed position, the first wall section and the second wall section are essentially vertically oriented to one another and the folded side wall is essentially oriented parallel to the base.

According to one aspect of the invention, the hinge pin in the hinge pin attachment can be translationally movable obliquely to the wall plane of the second wall section. In particular, the translational movement can occur within a direction angle range of 35° to 45°, preferably 45° to the wall plane of the second wall section, preferably the movement can occur towards an inner side of the container in the case of a container with inwardly folding wall sections and towards an outer side of the container in the case of a container with outwardly folding wall sections. In other words, the degree of translational freedom of the hinge pin in the hinge pin attachment can be configured in such a way that the hinge pin or hinge axis is movable towards the edge of the second wall section (which is lower or comprises the hinge attachment), around which the first wall section is pivoted. This oblique or diagonal movement of the hinge axis can reduce the distance to the inner edge of the second wall section (when folded inwardly) or the distance to the outer edge of the second wall section (when folded outwardly), which is why a bevel or rounding of the relevant edge is not necessary.

According to one aspect of the invention, the pair of guide contours can exhibits a guide protrusion configured on the first wall section and, configured on the second wall section, a guide groove in which the guide protrusion engages and glides along a guide contour formed at the bottom of the groove. The guide protrusion can be formed as a single piece on the first wall section. This can also in particular be configured to be rounded. What is more, the guide protrusion and guide groove can also be configured on the other wall section in each case. This solution is easy to produce and offers a long service life in use.

While the guide protrusion and guide groove allow a rotational movement of the wall sections around the rotational axis (which can be moved in parallel) and a translational movement vertically to the rotational axis, the guide protrusion and guide groove can be harmonized in such a way that they form an axial form fit, so that the hinge joint consisting of hinge pin and hinge pin attachment does not have to absorb or withstand forces applied in an axial direction by itself, since this is entirely or at least partially taken care of by the form fit.

In order to make the guide as low-friction as possible, the guide protrusion can be designed in the shape of a semicircle or a circular cylinder segment or disc, whereby as little contact and friction surface is provided as possible.

According to one aspect, the guide contour formed on the second wall section can be a rounded curve path superimposed with a wave or ramp. In other words, a wave or ramp is applied to a rounded path with radius R so that when the guide contour moves, the distance to the center of the rounded path initially increases (constantly) and then decreases (constantly).

According to one aspect, the hinge pin and the hinge pin attachment, in particular their cross-section shapes, can be mutually harmonized in such a way that they do not have any translational freedom in the wall plane in the open position (generally speaking in a vertical direction) but only obliquely or at most vertically to the wall plane. This ensures that in the upright state there is no significant clearance between the wall sections in the wall plane, so that the two wall sections are firmly connected in the upright state via the hinge joint and force transmission is enabled between the two wall sections.

According to one aspect, the hinge pin and the hinge pin attachment, in particular their cross-section shapes, can be mutually harmonized in such a way that they do not have any rotational freedom in the open position without previous translational shifting of the rotational axis. In this way, torque is absorbed by the hinge joint in the upright state. The rotational movement required to fold down the wall sections only occurs after a previous translational shift of the rotational axis. This ensures the folding capacity of the wall sections without having to dispense with a connection or force transmission in the upright state.

Another aspect of the invention concerns a container with two wall sections which are pivotable relative to one another and a hinge assembly according to one of the previous aspects. One of the two wall sections can be a container base to which a side wall is attached via the hinge assembly. Preferably, two opposite side walls can be provided with a hinge assembly according to aspects of the invention. According to one aspect, all four side walls of a foldable container can be provided with a hinge assembly according to aspects of the invention. The container according to aspects of the invention is designed such that the contact surface of the two reciprocally pivotable wall sections are as wide as possible in the upright state, since due to the rotational and translational movement carried out during pivoting, there is no need for a flattening, bevelling or rounding of the wall sections.

Otherwise, the container exhibits all the advantages described above in detail with the various aspects of the hinge assembly.

According to one aspect of the invention, the two wall sections are aligned with each other when opened and lie vertically on top of one another, whereby the pair of guide contours is configured in such a way that the upper wall section remains in the open vertical position by itself due to the weight force being applied to it, and in order to close the upper wall section it is raised against the weight force, in particular inwards and upwards, due to the rotational and translational movement of the hinge pin in the hinge pin attachment defined in this way by the pair of guide contours. This has the advantage that, without the intervention of the user and without having to overcome a predefined force, the wall section or side wall is not moved out of the upright position. In this way, the side wall is held in a vertical position when the hinge according to aspects of the invention is used. When it is closed, the side wall or wall section has to overcome resistance for the translational shift against the weight force of the wall section.

BRIEF DESCRIPTION OF THE DRAWINGS

The invention is best understood from the following detailed description when read in connection with the accompanying drawings. Included in the drawings are the following figures.

DETAILED DESCRIPTION OF PREFERRED EMBODIMENTS

Figure 1:
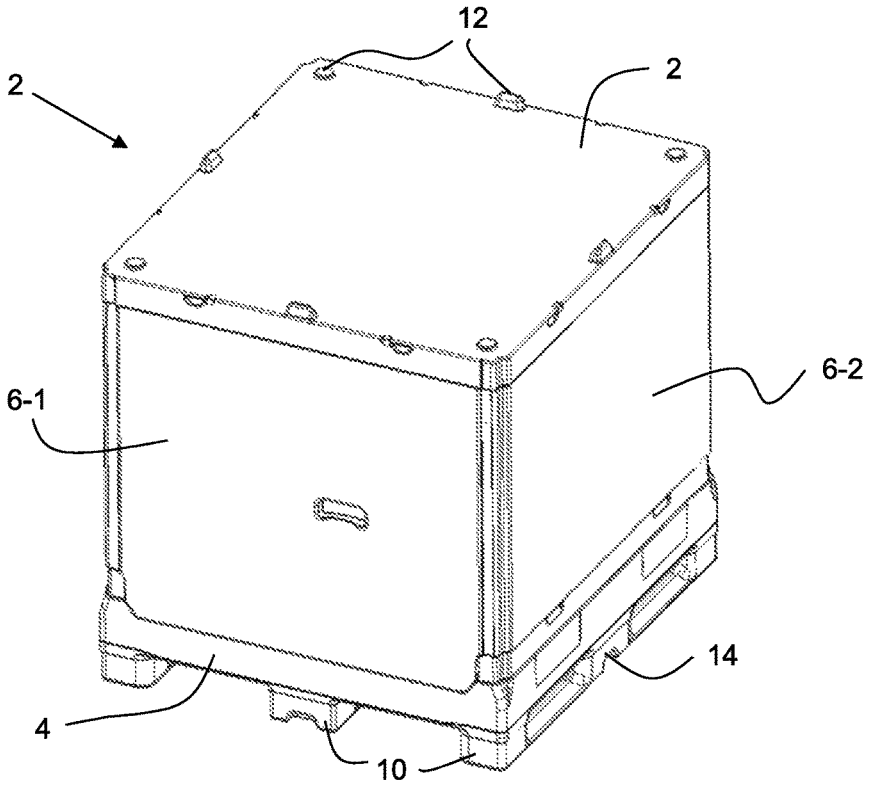
FIG. 1 shows a perspective view of a container according to a preferred embodiment of the invention in the opened state.

FIG. 1 shows a container 2, more precisely an Intermediate Bulk Container (IBC), which is made of plastic. The container comprises a base 4, four side walls 6 and a lid 8. The base 4 is pallet-shaped in configuration and comprises stacking feet or runners 10 in order to lift, transport and set down the container 2 using an industrial truck. In order to reliably stack several containers 2 on top of one another, the lid 8 has several stack protrusions 12 which engage in corresponding stack inserts 14 on the base 4 or the stacking feet 10 of an identical or compatible container 2 and thus secure the stacked containers 2 from slipping to the side with a form fit.

Figure 2:
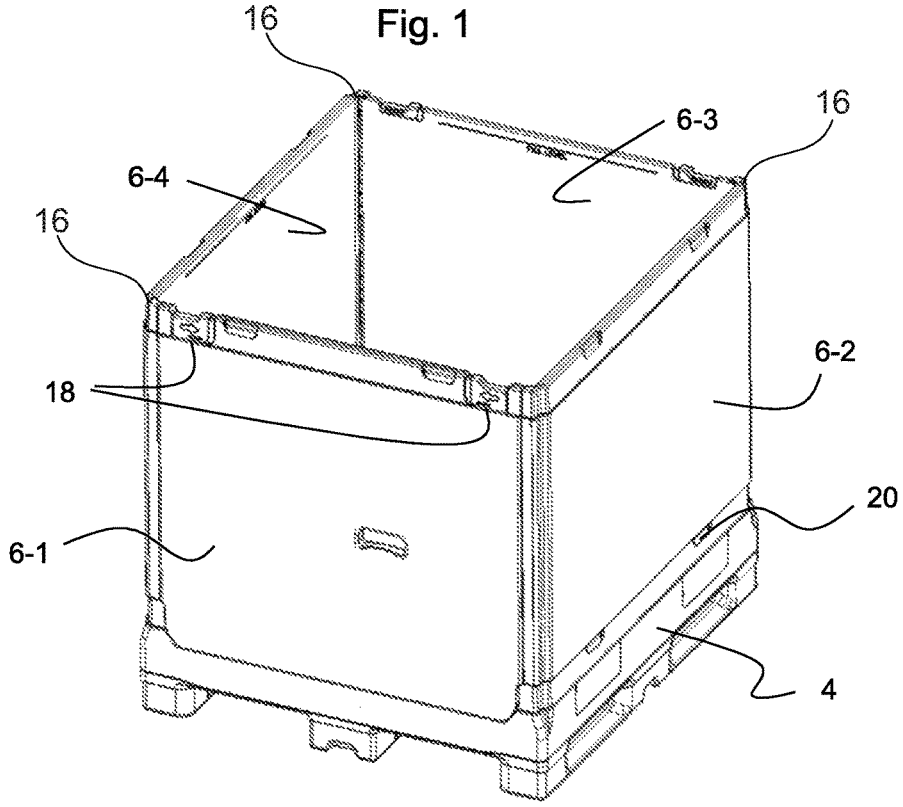
FIG. 2 shows a perspective view of the container in the opened state without lid.
Figure 3:
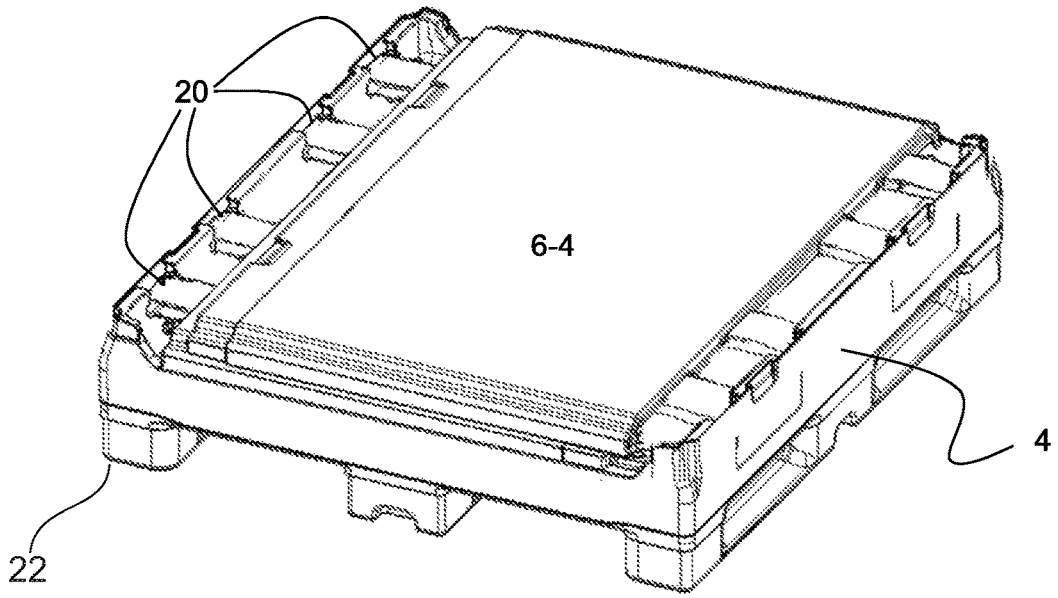
FIG. 3 shows a perspective view of the container in the closed state without lid.

FIG. 2 shows the container 2 with the lid 8 removed. As can be seen from FIG. 2, the side walls 6 have a recess 16 at their upper outer end sections for the flush support of the lid 8. In order to be able to transport or store the container 2 in an empty state in a space-saving manner, the side walls 6 can all be folded inwardly and top of one another (see FIG. 3). In the upright state shown in FIG. 2, the side walls 6 are connected and locked to the two neighboring side walls 6 at their side edges. In order to unlock the side walls, it is necessary to activate the corresponding locking elements 18. All in all, four locking elements 18 are provided which are configured at two opposite side walls 6-1 and 6-3 in the upper edge area, more precisely in the area of the recess 16, so that these, when the lid 8 is placed on the container 2, are covered or protected by the lid 8 and the locking elements 18 cannot be activated accidentally.

Figure 4:
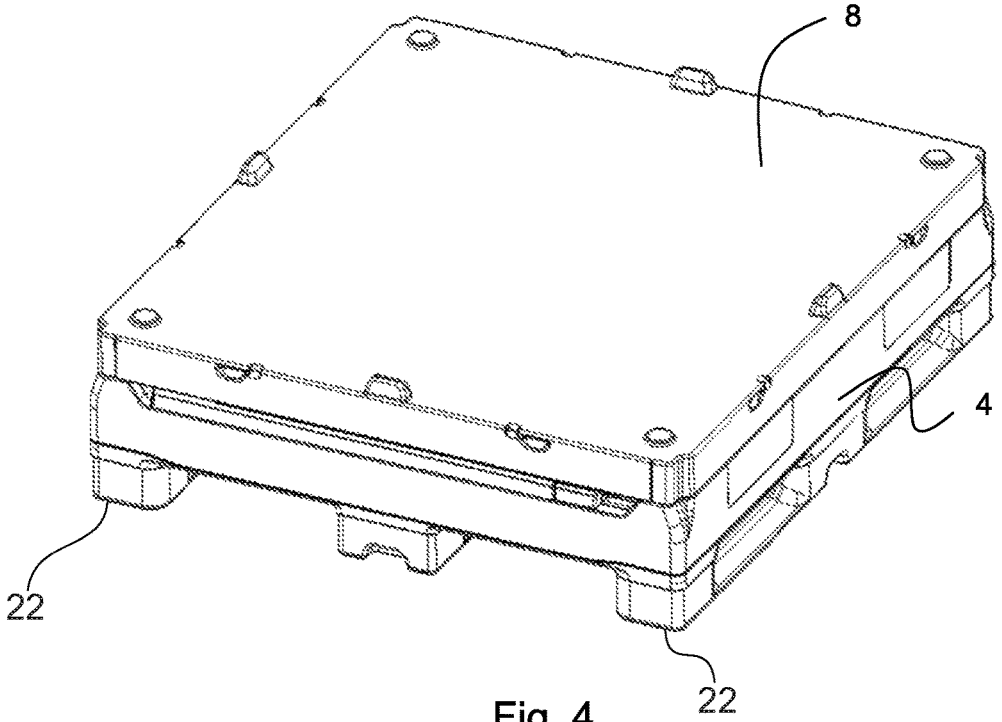
FIG. 4 shows a perspective view of the container in the closed state with lid.

When the side walls 6 are folded, the two opposite side walls 6-1 and 6-3 are first folded inwards and then on top of each other and subsequently two opposite side walls 6-2 and 6-4 are folded over them. The side walls 6 are each hinged to the base 4 via hinge assemblies 20. In order to enable the side walls to be folded on top of one another in as flat and parallel manner as possible, the pivot axes of the side walls 6-2 and 6-4 can be positioned vertically higher than the hinge axes of the two side walls 6-1 and 6-3, which are folded inwards first. When, as shown in the FIG. 3, the side walls 6 are folded inwards and on top of each other, the lid 8 can then once again be placed on top. For this purpose, the base 4 has corresponding recesses 22 at the corner edges, so that the lid 8 covers the side walls 6 and in particular the hinge assemblies 20, thereby also protecting them from external impact. In this way, the container 2, as shown in FIG. 4, can be stored complete with the lid 8 in a space-saving manner.

Figure 5:
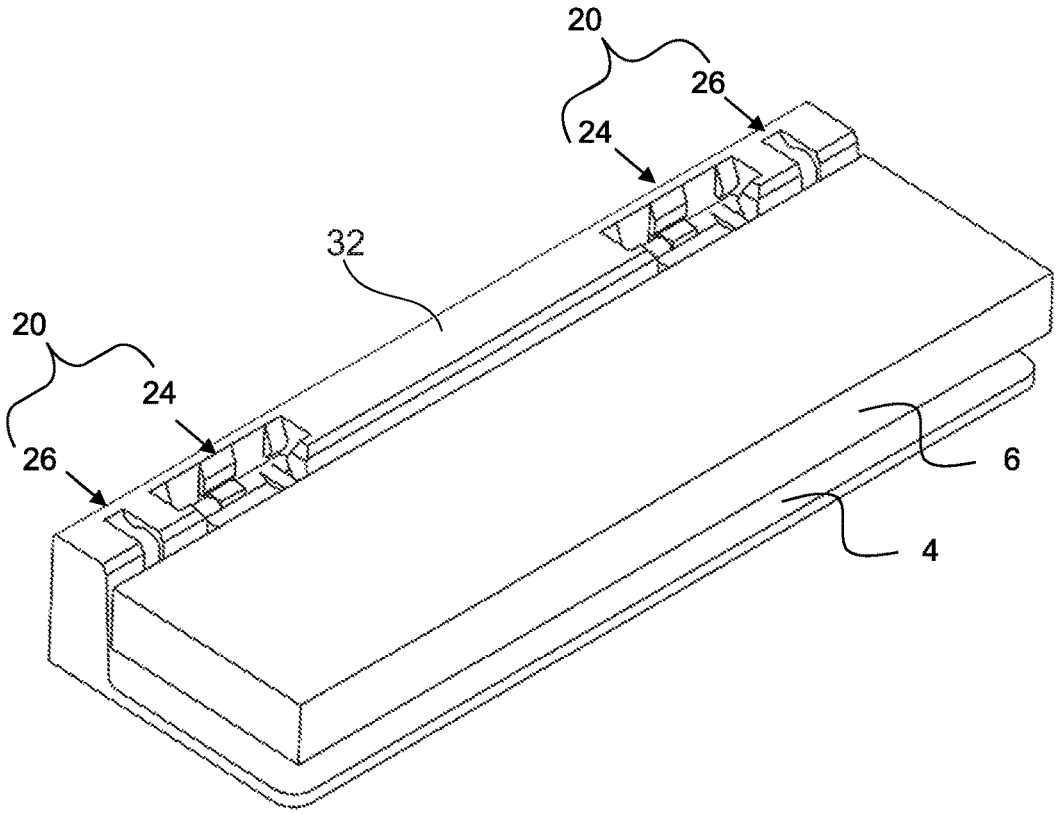
FIG. 5 shows a perspective view of two wall sections of the container which are pivotable relative to one another, with two hinge assemblies according to a preferred embodiment of the invention.
Figure 6:
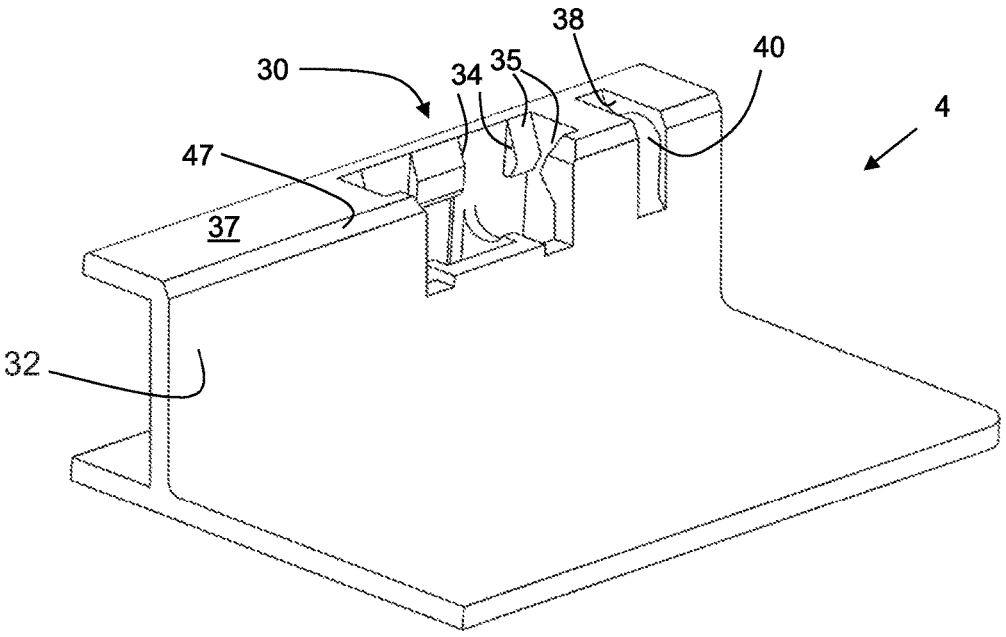
FIG. 6 shows a perspective view of a hinge assembly of one of the two wall sections (base) of the container.
Figure 7:
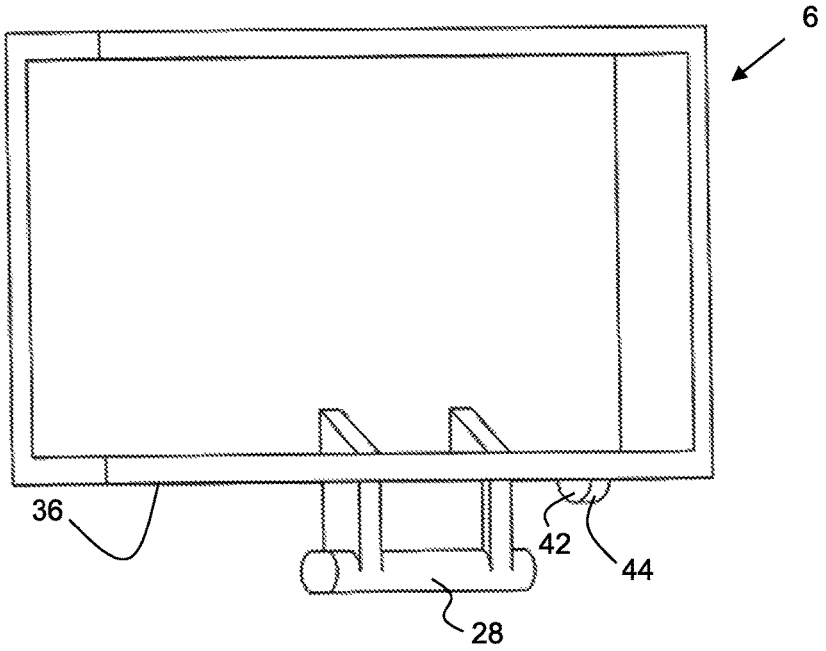
FIG. 7 shows a perspective view of the hinge assembly of the other of the two wall sections (side wall) of the container.

The hinge assembly 20 according to aspects of the invention is described below based on a model. FIG. 5 shows two articulately jointed wall sections corresponding to the side wall 6 and the base 4. The articulated joint is provided by two hinge assemblies 20, whereby each hinge assembly exhibits one hinge 24 and one pair of guide contours 26. The side wall 6 is connected to the base 4 via the hinge 24. The guide or the pair of guide contours 26 defines or specifies the pivoting movement of the side wall 6 relative to the base 4.

The hinge 24 is formed by a hinge pin 28, which is provided or formed as a single piece on the side wall 6, or more precisely on the latter's lower side or edge in the upright state, and a hinge pin attachment 30 which is configured at an upwardly extending edge section 32 of the base 4. The hinge pin 28 is secured in the hinge pin attachment 30 with locking studs 34 in a positively fitting manner. The locking studs 34 comprise insertion bevels 35 in order to facilitate initial insertion or latching of the hinge pin 28 into the hinge pin attachment 30.

In the upright state, a lower side surface 36 of the side wall 6 rests flatly on a contact or support area 37 at the upper side of the upwardly extending edge section 32.

Directly (in the axial direction) next to the hinge pin attachment 30, i.e. separately from the hinge pin attachment 30, a guide groove 38 is provided at the base 4 with a guide contour 40 formed at the bottom of the groove. This guide groove 38 or guide contour 40 interacts with a corresponding guide protrusion 42 configured on the side wall 6 next to the hinge pin 28 (and separately from the latter) with a guide contour 44. More precisely, when the side wall 6 is inserted with the hinge pin 28 in the hinge pin attachment 30, the guide protrusion 42 engages in the guide groove 38, whereby the guide contours 40 and 44 come into contact and slide along each other when the side wall 6 is pivoted relative to the base 4.

Figure 8A:
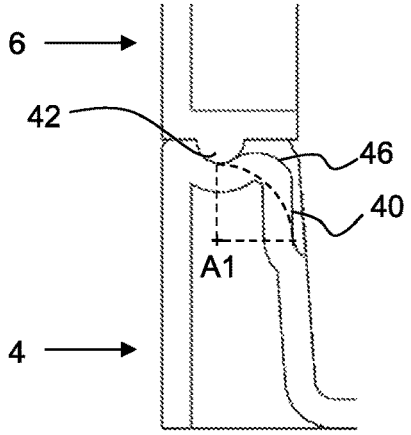
FIGS. 8A, 8B, and 8C show cross-section views of a guide contour pair of the hinge assembly in various pivot positions.
Figure 8B:
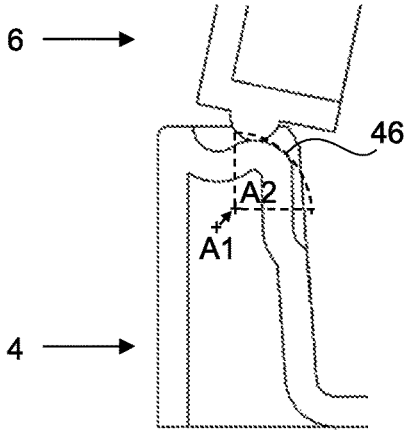
Figure 8C:
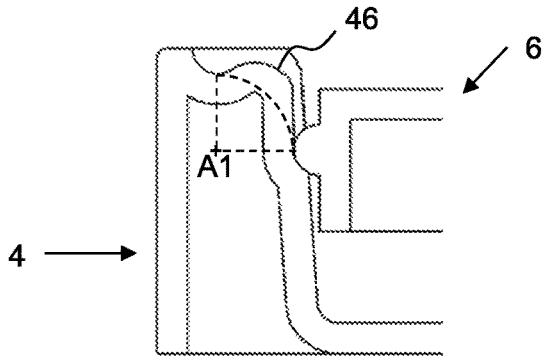

FIGS. 8A to 8C show cross sections through the pair of guide contours 46 made up of the guide contours 40 and 44 in various pivot positions. FIG. 8A shows the side wall 6 in an open or upright or vertically oriented position. FIG. 8C shows the side wall 6 in a state of being folded inwards by 90° and FIG. 8B shows the side wall 6 in an intermediate position between the open and closed position.

The guide contour 40 in the guide groove 38 is wave-shaped in configuration, i.e. the guide contour 40 does not exhibit a rounded path between the two end positions shown in FIGS. 8A and 8C but a rounded path superimposed with a wave. When the side wall 6 is closed or opened, the side wall 6 does not make a purely rotational movement, due to the interplay of the pair of guide contours 46, but a combined (simultaneous) rotational and translational movement. The hinge 24 is configured in such a way as to enable this combined rotational and translational movement.

What is more, the length of the guide groove 38 limits the pivoting movement range of the side wall 6 so that the two end positions (FIG. 8A and FIG. 8C) are defined by the interplay between the guide protrusion 42 and guide groove 38. Furthermore, the guide protrusion 42 is mounted in the guide groove 38 without any significant axial clearance, so that the guide groove 38 and the guide protrusion 42 create an axial form fit and are therefore able to absorb axial loads acting on the side wall 6 and thereby relieve the hinge 24.

Figure 9A:
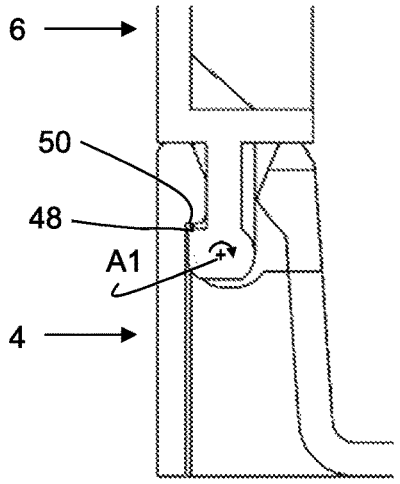
FIGS. 9A, 9B, and 9C show cross-section views of a hinge of the hinge assembly in various pivot positions.
Figure 9B:
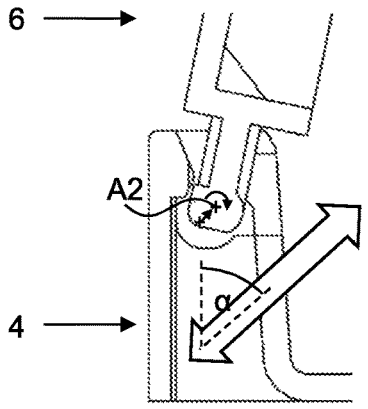
Figure 9C:
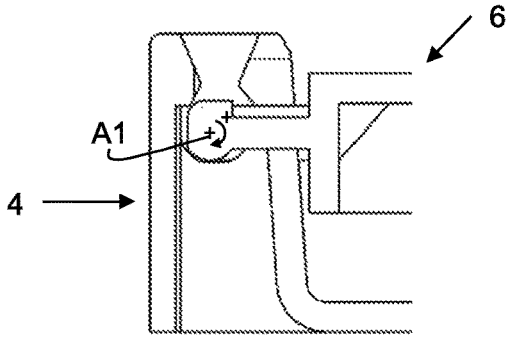

FIGS. 9A to 9C show cross sections of the hinge 24 in various pivot positions. FIG. 9A shows the side wall 6 in the upright or open state and FIG. 9C shows it in the inwardly closed state. The intermediate pivot position shown in FIG. 9B directly after the start of the inward pivoting movement largely corresponds to the pivot position in FIG. 8B. As can be seen from FIGS. 9A to 9C, the hinge pin 28 is mounted in the hinge pin attachment 30 so as to be rotatably and translationally movable. Therefore, when the guide protrusion 42 on the side wall 6 glides over the highest point of the wave 46 of the guide contour 40, the rotational axis defined by the hinge pin 28 is shifted from a position A1 into a position A2 (parallel) and then shifted back again, so that the rotational axis of the hinge pin 28 in the closed position (FIG. 9C) is back in position A1. The translational movement between positions A1 and A2 occurs obliquely to the upwardly extended edge section 32 of the base 4 or at an angle of approx. 45° in relation to the vertical axis or the wall plane, more precisely inwards and upwards or in the direction of an inner edge 47 of the upwardly extended edge section 32 at which the hinge pin attachment 30 is configured.

From FIGS. 9A to 9C it can also be seen that the hinge pin 28 does not exhibit a circular cross section but that at least at one partial section there is a corner or edge 48 which interacts with a corresponding inner edge 50 inside the hinge pin attachment 30 in the upright position (see FIG. 9A). The corner 48 located at the upper and outer side of the hinge pin 28 in upright position reaches behind the inner edge 50 likewise configured at the upper and outer inner side of the hinge pin attachment 30 in the upright position. This prevents the side wall 6 from being able to move in a vertical direction in the upright state. As a result, there is an indirect force transmission or connection between the base 4 and side wall 6. What is more, the interplay between the corner edges 48 and 50 prevents the hinge pin 28 from rotating when the hinge axis is in position A1. In order to initiate the rotational movement, it is therefore necessary as shown in FIG. 9B to first move the hinge axis translationally inwards or obliquely inwards so that the two corner edges 48 and 50 are disengaged, thereby enabling a translational and rotational movement of the hinge pin 28 in the hinge pin attachment 30. In view of this, the side wall 6 and the base 4 are connected in upright position due to the rear grip or positive fit between the corner edges 48 and 50 in the vertical and rotational direction.

During the pivoting movement, the hinge pin 28, which is also translationally movable in the hinge pin attachment 30, is guided via the pair of guide contours 46 so that the hinge pin 28 and hinge pin attachment 30 cannot become jammed during pivoting. However, a significant benefit of the invention lies in the fact that the support surface 37 at the upwardly extending edge section of the base 4, on which the side wall 6 rests with its lower side surface 36, can be designed to be very wide in the upright state, since the inner edge 47 at the support surface 37 does not have to be bevelled or rounded or only very slightly, since the lower edge or side surface 36 of the side wall 6 is always "lifted" above the inner edge 47 during the rotational and translational movement. The widened support surface 37 improves the force transmission and the strength of the side walls in the upright state.

Furthermore, the wave 46 in the guide contour 44 has the additional advantage that—as shown in FIG. 8A—the guide protrusion 42 first has to overcome the wave 46, initially running upwards in a vertical direction, when the side wall 6 pivots inwards, at the same time involving a certain oblique lifting movement of the side wall 6, which is why the side wall 6 tends to move back into the upright position (FIG. 8A) due to the force of its own weight. The side wall 6 therefore remains in the upright position by itself due to the pair of guide contours and gravity and does not fold back inwards by itself or without user intervention. In order to fold the side wall 6 inwards, the resistance of the wave 46 or the weight force of the side wall 6 has to be overcome.

The present invention was described based on a preferred embodiment. However, the hinge assembly 20 according to aspects of the invention consisting of the hinge 24 and the pair of guide contours 26 can also be applied to other folding containers.

The hinge assembly 20 was described in connection with an articulated joint between a side wall 6 and the base 4. However, the hinge assembly 20 according to aspects of the invention can also be provided between other wall sections of a container, for example between two superimposed side wall sections.

Furthermore, the hinge assembly 20 can also be used for side walls which fold outwards, whereby here the hinge 24 and the pair of guide contours 26 have to be configured inversely as appropriate.

Instead of the wave 46, it is also possible to use a type of ascending and descending ramp geometry or a differently configured geometry, providing care is taken to ensure that the closing side wall is guided obliquely inwards at the top (or obliquely outwards at the top in the case of an outwardly folding side wall) during the pivoting movement.

In the embodiment described, only a central section of the hinge pin 28 is provided with a non-rounded cross section or the corner edge 48. Alternatively, the entire hinge pin 38 can be configured in this way along its axial extent.

The invention claimed is:

1. A hinge assembly between two wall sections of a container which are pivotable relative to one another, the hinge assembly comprising:

a hinge pin provided at a first wall section, the hinge pin having a rotational axis;

a hinge pin attachment provided at a second wall section, the hinge pin fitting positively in the hinge pin attachment and being rotationally and translationally movable to allow a parallel shift of the rotational axis of the hinge pin; and a pair of guide contours provided on the wall sections, in contact with one another and formed separately from the hinge pin and the hinge pin attachment to define simultaneous rotational and translational movement of the hinge pin in the hinge pin attachment;

wherein the pair of guide contours comprises a rounded guide protrusion formed on the first wall section, and a guide groove configured on the second wall section, in which the guide protrusion engages and glides along a guide contour formed at a bottom of the guide groove;

and wherein the pair of guide contours is configured such that, when the wall sections are pivoted from an open position to a closed position, the rotational axis of the hinge pin initially moves away from a starting position and then moves back into the starting position.

2. The hinge assembly according to claim 1, wherein the wall sections can be moved from the open position in which the first wall section and the second wall section are oriented vertically to one another, into the closed position, in which the first wall section and the second wall section are oriented parallel to one another.

3. The hinge assembly according to claim 2, wherein the first wall section is a side wall of the container and the second wall section is a base of the container.

4. The hinge assembly according to claim 1, wherein the hinge pin in the hinge pin attachment is translationally movable obliquely to a wall plane of the second wall section.

5. The hinge assembly according to claim 4, wherein the hinge pin in the hinge pin attachment is translationally moveable obliquely in a direction angle range of 35° to 55° to the wall plane towards an inner side of the container.

6. The hinge assembly according to claim 1, wherein the guide protrusion and the guide groove create an axial form fit between the two wall sections.

7. The hinge assembly according to claim 1, wherein the guide protrusion has the shape of a semicircle or a circular cylinder segment.

8. The hinge assembly according to claim 1, wherein the rounded guide protrusion is formed on the first wall section in a single piece.

9. The hinge assembly according to claim 1, wherein the guide contour configured at the second wall section has a profile of a rounded curve path superimposed with a wave or a ramp.

10. The hinge assembly according to claim 1, wherein the hinge pin and the hinge pin attachment comprise opposing surfaces that contact one another to prevent translational movement of the hinge pin relative to the hinge pin attachment in the plane of the first wall when the wall sections are in the open position, but allow movement of the hinge pin relative to the hinge pin attachment inside the hinge pin attachment in directions that are oblique or vertical relative to the plane of the first wall when the walls sections are in the open position.

11. The hinge assembly according to claim 10, wherein cross-section shapes of the hinge pin and the hinge pin attachment do not permit rotational freedom in the wall plane in the open position without previous translational shifting of the rotational axis.

12. A container comprising:

at least a first wall section and a second wall section, which are pivotable relative to one another a hinge assembly comprising:

a hinge pin provided at the first wall section, the hinge pin having a rotational axis;

a hinge pin attachment provided at the second wall section, the hinge pin fitting positively in the hinge pin attachment and being rotationally and translationally movable to allow a parallel shift of the rotational axis of the hinge pin; and a pair of guide contours provided on the wall sections, in contact with one another and formed separately from the hinge pin and the hinge pin attachment to define simultaneous rotational and translational movement of the hinge pin in the hinge pin attachment;

wherein the pair of guide contours comprises a rounded guide protrusion formed on the first wall section, and a guide groove configured on the second wall section, in which the guide protrusion engages and glides along a guide contour formed at a bottom of the guide groove;

and wherein the pair of guide contours is configured such that, when the wall sections are pivoted from an open position to a closed position, the rotational axis of the hinge pin initially moves away from a starting position and then moves back into the starting position.

13. The container according to claim 12, wherein, when positioned in the open position, the two wall sections are aligned with each other and lie vertically on top of one another with the first wall section positioned on top of the second wall section and the pair of guide contours is configured such that the first wall section remains in the open position by itself due to a gravitational weight force being applied to it, and wherein the pair of guide contours and the hinge pin attachment are configured such that, in order to move the first wall section to the closed position, the first wall section must be raised against the weight force due.

14. The container according to claim 13, wherein the upper wall section is raised inward and upward to close the upper wall section.

* * * * *